United States Patent [19]

Anderka

[11] 4,103,999

[45] Aug. 1, 1978

[54] RUPTURABLE SEALING ELEMENT WITHIN AN INK RESERVOIR CARTRIDGE

[75] Inventor: Gerold Anderka, Ellerbek, Fed. Rep. of Germany

[73] Assignee: Koh-I-Noor Rapidograph, Inc., Bloomsbury, N.J.

[21] Appl. No.: 750,497

[22] Filed: Dec. 14, 1976

[30] Foreign Application Priority Data

Dec. 31, 1975 [DE] Fed. Rep. of Germany ..... 2559294

[51] Int. Cl.[2] ..... B43K 23/02

[52] U.S. Cl. ..... 401/134; 225/2

[58] Field of Search ..... 401/134, 132, 133, 135; 225/2, 96; 220/266

[56] References Cited

U.S. PATENT DOCUMENTS

| | | | |
|---|---|---|---|
| 2,911,664 | 11/1959 | Zecchini | 401/132 |
| 2,961,999 | 11/1960 | Torchi | 401/134 X |
| 4,005,808 | 2/1977 | Insolio | 225/2 |

FOREIGN PATENT DOCUMENTS

| | | | |
|---|---|---|---|
| 1,569,112 | 5/1969 | France | 401/134 |

*Primary Examiner*—Stephen C. Pellegrino
*Attorney, Agent, or Firm*—David H. Semmes

[57] ABSTRACT

In capillary writing pens of the type having a scribing point and a replaceable ink cartridge, a method of manufacturing a rupturable sealing element for the cartridge, such that minimal pressure is required to be applied to rupture, while ensuring secure sealing of the ink prior to the use of the cartridge.

1 Claim, 2 Drawing Figures

RUPTURABLE SEALING ELEMENT WITHIN AN INK RESERVOIR CARTRIDGE

BACKGROUND OF THE INVENTION

1. Field of the Invention

The invention relates to a process for manufacturing tubular shaped plastic ink reservoir cartridges, which may be injection molded. The cartridges may be placed on top of a writing instrument or may be inserted into a writing instrument. Upon attachment or insertion, the sealing element of the cartridge is destroyed, or at least penetrated, at an assigned breaking point. This breaking point is designed to be of a thinner material strength.

2. Description of Prior Art

West German DT-PS 1 274 928 is an example of this type of ink cartridge, and they are generally manufactured in an injection molding process. In order to produce, simultaneously, by means of the injection process also the preset breaking points, in the cartridge sealing element, the injection mold die must be able to form regions of thinner material strength which can make leakproof seals between the sealing element and the remaining part of the ink cartridge containing the ink reservoir chamber. However, in the case of injection molding, and also in other processes used in the manufacturing of ink cartridges, one encounters relatively large variations in tolerances. Therefore it is necessary that in the area of the reduced material strength, a certain minimum thickness is provided so that even in case of large tolerance fluctuations, the tight seal of the ink reservoir chamber remains assured.

Conventionally, there is a necessity for adhering to the lower limit in respect to material thickness in manufacture by injection molding, wherein predetermined breaking points are obtained which can only be penetrated by the use of large amounts of energy. In the case of conventional ink cartridges, the tearing forces or penetration forces required for severing the breaking points are on the order of 6 kp to 12 kp.

In order to avoid a high rejection rate because of insufficient seal in the preset breaking point area, in the manufacture of ink cartridges by the aforementioned process, it is necessary that the user must apply relatively large amounts of energy or force in order to open the flow exits by rupturing the preset breaking points in the sealing element.

SUMMARY OF THE INVENTION

The object of the present invention is, therefore, to find a method for the production of tubular shaped ink reservoir cartridges which permits the creation of penetration points having a material thickness considerably less at the point of penetration than the thickness of ink reservoir cartridges which have been produced to date. At the same time, the integrity of the seal is assured. The problem is solved by means of the present invention in that the reduction of the plastic material's thickness in the area of the preset penetration point is accomplished sequentially of injection molding by means of a cutting or slicing force or by means of a shaping or deformation pressure.

Thus, the present invention does not produce the material's thickness reduction in the area of the preset breaking point at the same time that the one piece, cartridge and sealing element, is made. Nor is the thickness reduction made when the sealing element is attached to the cartridge body. Rather, the thickness reduction is produced in a subsequent and separate work phase. Therefore, the material thickness in the area of the preset penetration point can be very carefully preset to any desired value without running the risk of creating leaks. Thus, it is possible, for example, to reduce the wall thickness in the area of the preset penetration point down to 0.1 mm. As a result, the required tearing, rupturing or penetration forces can be materially reduced vis a vis conventional ink reservoir cartridges; indeed these forces can be less than 3 kp.

Ink reservoir cartridges made from a tubular body and whose one terminal end has a sealing element and whose other terminal end is open (DT-PS 1 274 928), allow for the admission of the cutting force or the deformation pressure through a taper plug inserted into the open end and resting against the lower side of the sealing element. In this fashion it is possible to easily control the cutting force or the deformation pressure. Thus, even when the material thickness is reduced to very small values, perhaps in the range of 0.1 mm, there is no danger that the applied force or the applied pressure will lead to a partial destruction of the penetration point which, in such case, would make the cartridge unusable.

To apply the cutting force, it is possible, for example, to use a ring shaped cutting tool. This cutting tool, especially in cases when the ink cartridge is made of plastic material, can be heated and thus allows for an easy reduction of the material's thickness.

It is, of course, apparent that the cutting force or respectively, the deformation pressure must be applied in a fashion - perhaps by means of ultrasonics - and with a pressure device that will assure a steady flowing of the plastic material.

DESCRIPTION OF THE PREFERRED EMBODIMENTS

Figure 1:
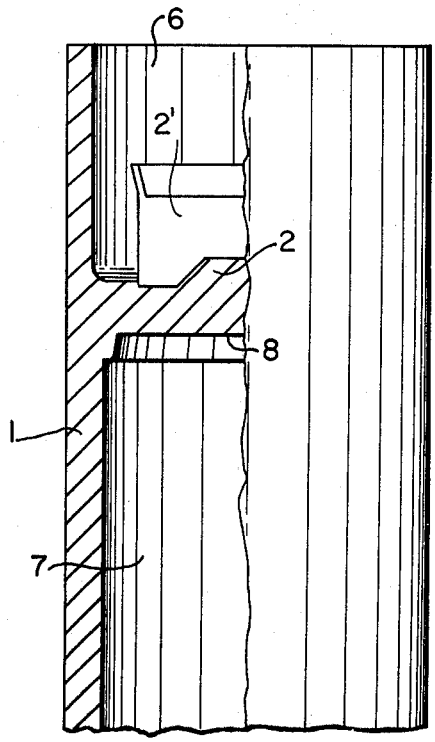
FIG. 1 is a fragmentary vertical section of a tubular ink reservoir cartridge with an ink exit opening in the form of a sealing element.
Figure 2:
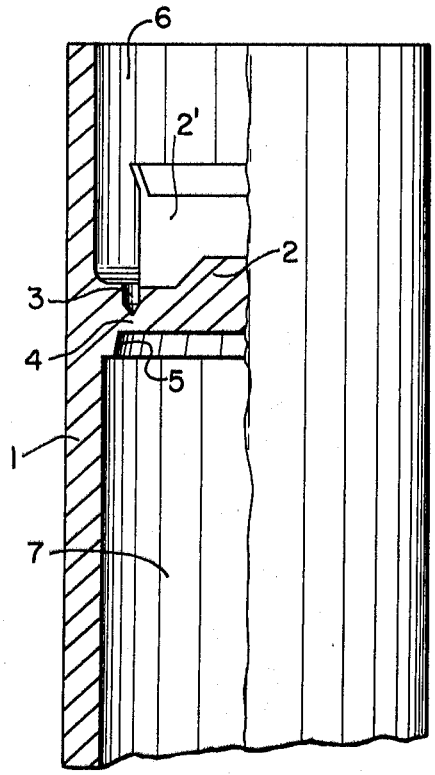
FIG. 2 is a similar view showing the sealing element with a preset breaking point, obtained by means of the present invention.

The tubular shaped body with the sealing element for an ink reservoir cartridge that is shown in the figures, is part of a cartridge whose assembly and function corresponds, to a large extent, to those of German DT-PS 1 274 928. That is, the tubular shaped body and the sealing element are made of one piece and the tubular shell is then filled from the rear with ink. Afterwards, the rear filling opening is closed by means of a plug that is welded-in or glued-in.

Only a part of tubular shell 1 having ink filling end 7 and ink flowing end 6 and only a part of the sealing element 2 can be seen in the drawings. Sealing element 2 has, along its upper part, a cross slot or notch 2' which, when sealing element 2 is pushed through the ink reserve chamber, sealing element 2 with its now enlarged upper end remains suspended alongside the inwardly turned circular rib 5 of the tubular shaped body 1. Thus, ink can now flow through slot 2' from the ink reservoir chamber as is described in detail in DT-PS 1 274 928.

In case of an ink reservoir cartridge that is produced in accordance with the present invention, and as illustrated in FIG. 1, tubular shell 1 and the sealing element 2 initially are made as one piece of plastic in an injection molding process. In the area of the joint between sealing element 2 and tubular shell 1, a relatively large material thickness is produced which, of course, is not suited as a preset breaking point.

In the crude or unfinished piece that is thusly produced, a cutting tool is inserted from the front; i.e., the free or open end of sealing element 2. For example, a ring shaped cutting tool such as a knife with a circular cut that has, preferably, been heated. Such a circular cutting tool produces, in the area of transition from sealing element 2 to tubular shell 1, a circular notch or an annular tee-slot 3 whose depth is controlled by the knife and this depth is pre-selected so as to assure no leaks while still allowing a minimum material thickness of plastic, for example, 0.1 mm. Thus is created the preset breaking point 4. This breaking point can be penetrated by applying a relatively small pressure when placing the ink reservoir cartridge, upon the rear of a scriber point, so that sealing element 2 is partially pushed into the ink reservoir chamber and allows the ink to exit.

It must be pointed out, that when producing the annular tee-slot 3, a mandrel (not illustrated) which serves as an outer support, should be pressed against the opposed side 8 of sealing element 2. This allows for a more accurate guiding of the cutting tool (not illustrated) and prevents an accidental breaking of sealing element 2, containing the preset breaking point at the time that the annular tee-slot 3 is produced.

The foregoing describes the invention relative to cartridges made of plastic and produced by means of an injection molding process. However, it is obvious that the invention can be applied in cases of other types of ink cartridges. For example, it is possible to produce in the described fashion preset breaking points for ink cartridges with welded-in or glued-in covers. Here again, it will be possible to penetrate or tear the sealing element or cover by applying a relatively small force. Furthermore, the process defined by this invention, can also be applied to ink cartridges that are not made by means of injection molding but, for example, by means of deep drawing.

I claim:

1. In a capillary writing pen of the type having a scribing point, a tubular shaped ink reservoir cartridge, further including:

A. An open ended elongated chamber having a filling end and an ink flowing end;

B. A reservoir defined in said filling end and including an inwardly turned circular rib;

C. A rupturable reduced thickness sealing element for said ink flowing end, said sealing element being further defined by;

i. a transverse petition within said elongated chamber and adjacent said inwardly turned circuit rib and, ii. a circular exterior notch defining a preset rupturing point as said sealing element engages an inner end of the scribing point;

iii. an enlarged upper end axially offset with respect to said circular rib and engagable with said inwardly turned circular rib, as said sealing element is ruptured and so as to permit ink flow.

* * * * *